US008808033B2

(12) United States Patent
White

(10) Patent No.: US 8,808,033 B2
(45) Date of Patent: Aug. 19, 2014

(54) GROUND POWER CONNECTOR SAVER

(75) Inventor: John Andrew White, Thousand Oaks, CA (US)

(73) Assignee: Cooper Technologies Company, Houston, TX (US)

( * ) Notice: Subject to any disclaimer, the term of this patent is extended or adjusted under 35 U.S.C. 154(b) by 102 days.

(21) Appl. No.: 13/483,826

(22) Filed: May 30, 2012

(65) Prior Publication Data

US 2013/0323982 A1 Dec. 5, 2013

(51) Int. Cl.
*H01R 24/00* (2011.01)
*H01R 33/00* (2006.01)

(52) U.S. Cl.
USPC ..... 439/660; 439/34; 439/364

(58) Field of Classification Search
USPC ..... 439/660, 252, 682, 752, 34, 263, 364
See application file for complete search history.

(56) References Cited

U.S. PATENT DOCUMENTS 4,758,175 A 7/1988 Didier et al.
5,256,081 A 10/1993 Didier
5,998,772 A * 12/1999 Kirma et al. ..... 219/541
6,210,036 B1 * 4/2001 Eberle et al. ..... 374/141
6,250,969 B1 * 6/2001 Cai ..... 439/682
6,709,274 B2 * 3/2004 Lazaro et al. ..... 439/34
6,832,925 B2 * 12/2004 Draggie et al. ..... 439/263
7,527,533 B2 * 5/2009 Lappoehn ..... 439/751
7,771,242 B2 * 8/2010 Xue et al. ..... 439/752
7,980,875 B2 * 7/2011 Gosis et al. ..... 439/265
2002/0039846 A1 * 4/2002 Lazaro et al. ..... 439/34
2004/0038576 A1 * 2/2004 Draggie et al. ..... 439/263
2009/0264020 A1 * 10/2009 Xue et al. ..... 439/660
2013/0316591 A1 * 11/2013 White ..... 439/660

* cited by examiner

*Primary Examiner* — Hae Moon Hyeon
(74) *Attorney, Agent, or Firm* — King & Spalding LLP

(57) ABSTRACT

A ground power connector saver for electrically and mechanically connecting a ground power connector to an aircraft fixed connector, the ground power connector saver having: an internal block having a number of cavities, each cavity having an inside dimension and a pivot engagement; a socket group having a number of sockets, each socket having a female tyne section having an outside dimension and a pivot engagement; and a body that houses the internal block and the tyne sections of the sockets and includes a flexible portion that flexibly seals respective ends of the tyne sections of the sockets in the cavities, where male pin contacts of the socket group extend from the body.

13 Claims, 20 Drawing Sheets

GROUND POWER CONNECTOR SAVER

TECHNICAL FIELD

Embodiments of the invention relate generally to ground power connectors used on commercial and military aircraft, and more particularly to connector savers or replaceable noses for ground supply power connectors (plugs).

BACKGROUND

Between flights, commercial and military aircraft typically park at a terminal facility. When parked, the aircraft engines are generally powered down for ground crew safety. Electrical power that would otherwise be supplied by the aircraft engines may be supplied by an external source, such as a ground power cart or a generator associated with a skybridge, an aircraft carrier for NAVY applications or an aircraft hanger. A ground power connector at the end of a power supply cable couples the external power source to the aircraft. Commercial and military aircraft typically have a fixed connector somewhere on the side or underside, usually near the front or aft of the aircraft. Aircraft fixed connectors comprise a receptacle with male contact pins positioned therein. Ground power connectors comprise a plug with female sockets positioned therein, wherein the plug mates with the receptacle and more specifically the female sockets mate with the male contact pins.

The coupling between the ground power connector and the fixed aircraft connector is typically maintained by a physical engagement of the mating forces at both the plug/receptacle and pin/socket interfaces. Some configurations include straps or other mechanisms to hold the ground power connectors to the aircraft. The Engineering Society for Advancing Mobility Land Sea Air and Space (SAE) has promulgated an Aerospace Standard related to cable assemblies and attachable plugs for external electric power (SAE AS7974). If the total mating forces are not sufficient to maintain the coupling between the aircraft fixed connector (receptacle) and the ground power connector (plug), gravitational forces will disconnect the ground power connector (plug) from the aircraft fixed connector (receptacle), and the ground power connector (plug) will drop to the ground. This low force condition also contributes to high resistance between the pins and sockets which results in excess heat generation that can damage the aircraft and ground power connectors. In addition to the potential for damage to the ground power connector (plug), it is undesirable for the ground power connector (plug) to prematurely disconnect from the aircraft fixed connector (receptacle), because a disconnect results in arcing between the pin and socket contacts that can cause permanent damage to the contacts and a loss of power supply to the aircraft.

A socket contact is a female contact designed to mate to a male or pin contact. It is normally connected to the "line" side of a circuit. It is also important for each of the individual female sockets of the ground power connector (plug) to maintain physical engagement through coupling forces with each of the corresponding individual male pins of the aircraft fixed connector (receptacle). When physical engagement through coupling forces is not maintained between a pin and a socket, electrical arcing may generate excessive heat and increased electrical resistance to the power supply. Electrical arcing and excessive heat may prematurely damage the pin or the socket.

In typical commercial and military terminal operations, ground power connectors are coupled/decoupled to/from several different aircraft each day. The simple action of inserting the ground power connector (plug) into an aircraft fixed connector (receptacle) wears mating surfaces at both the plug/receptacle and pin/socket interfaces. Such wear may contribute to insufficient mating forces to maintain physical engagement. Further, such wear at the pin/socket interface may lead to poor physical engagement so as to result in electrical arcing and excessive heat at one or more of the individual pin/socket interfaces.

Other typical wear occurs when ground power connectors are removed from the aircraft and fall to the ground causing abrasion to the surfaces of the connectors. Typically this abrasion occurs on the front corners of the connectors. When severe, the corners are worn past the rubber and expose the ground operations personnel to exposed socket surfaces. To a lesser degree, abrasion occurs on all of the surfaces when the connectors a dragged across the ground surface during storing and deploying operations.

One industry solution to address these problems is to use a ground power connector (plug) that has a disposable connector saver or a replaceable nose at the end for engagement with aircraft. When the useful life of the disposable connector saver or replaceable nose has come to an end, it is only required to replace the disposable connector saver or replaceable nose, rather than the entire ground power connector (plug).

Standard connector savers or replaceable noses are attached through a non-standard set of mating contacts, which renders the back section of the connector useless for connecting to aircraft. Typical ground power connectors (plugs) that use a connector saver or replaceable nose have no interface to engage an aircraft unless a connector saver or replaceable nose is attached to a base portion of the ground power connector (plug). Thus, once a connector saver or replaceable nose has become inoperable, the entire ground power connector (plug) is inoperable until a new connector saver or replaceable nose is attached to the base portion of the ground power connector (plug).

SUMMARY

In accordance with the teachings of the present disclosure, disadvantages and problems associated with ground power connector savers have been reduced.

According to one aspect of the invention, there is provided a ground power connector saver for electrically and mechanically connecting a ground power connector to an aircraft fixed connector, the connector saver comprising: a connector saver body; and a socket group positioned partially within the connector saver body, wherein each socket comprises a female tyne section and a male pin contact, wherein the male pin contacts of the socket group have a configuration fully compatible and mateable with the aircraft fixed connector.

Another aspect of the invention provides a ground power connector saver for electrically and mechanically connecting a ground power connector to an aircraft fixed connector, the connector saver comprising: an internal block comprising a plurality of cavities, each cavity having an inside dimension and a pivot contact; a socket group comprising a plurality of sockets, each socket comprising a female tyne section comprising an outside dimension and a pivot contact, wherein each female tyne section is positioned within a cavity, wherein the outside dimension of the tyne sections are smaller than the inside dimensions of the cavities, wherein the pivot contacts of the internal block and the sockets are engaged to support the sockets in the cavities so as to enable the sockets to pivot within the cavities at the pivot contacts, wherein each socket of the socket group comprises a male pin contact, wherein the male pin contacts of the socket group have a configuration similar to the aircraft fixed connector; and a body 10 that houses the internal block and the tyne sections of the sockets and comprises a flexible portion that flexibly seals respective ends of the tyne sections of the sockets in the cavities, wherein the male pin contacts of the socket group extend from the body. The inside dimension of each cavity allows the socket to pivot freely, to accommodate aircraft receptacle damage and provide consistent resistance and plug mating and demating force.

According to a further aspect of the invention, there is provided a method of manufacturing a ground power connector saver having a socket group, the method comprising: providing an internal block comprising a plurality of cavities; inserting tyne portions of a plurality of sockets of the socket group into the cavities of the internal block; sealing the cavities of the internal block; and molding a rubber connector saver body onto an exterior of the internal block so that the connector saver body flexibly supports the tyne sections of the sockets in the cavities and male pin contacts of the sockets protrude from the connector saver body.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features. Reference will now be made to the accompanying drawings, which are not necessarily drawn to scale, and wherein:

FIG. 3G is a cross-sectional perspective view of the top of the internal block and socket group of FIG. 3A.

Figure 1:
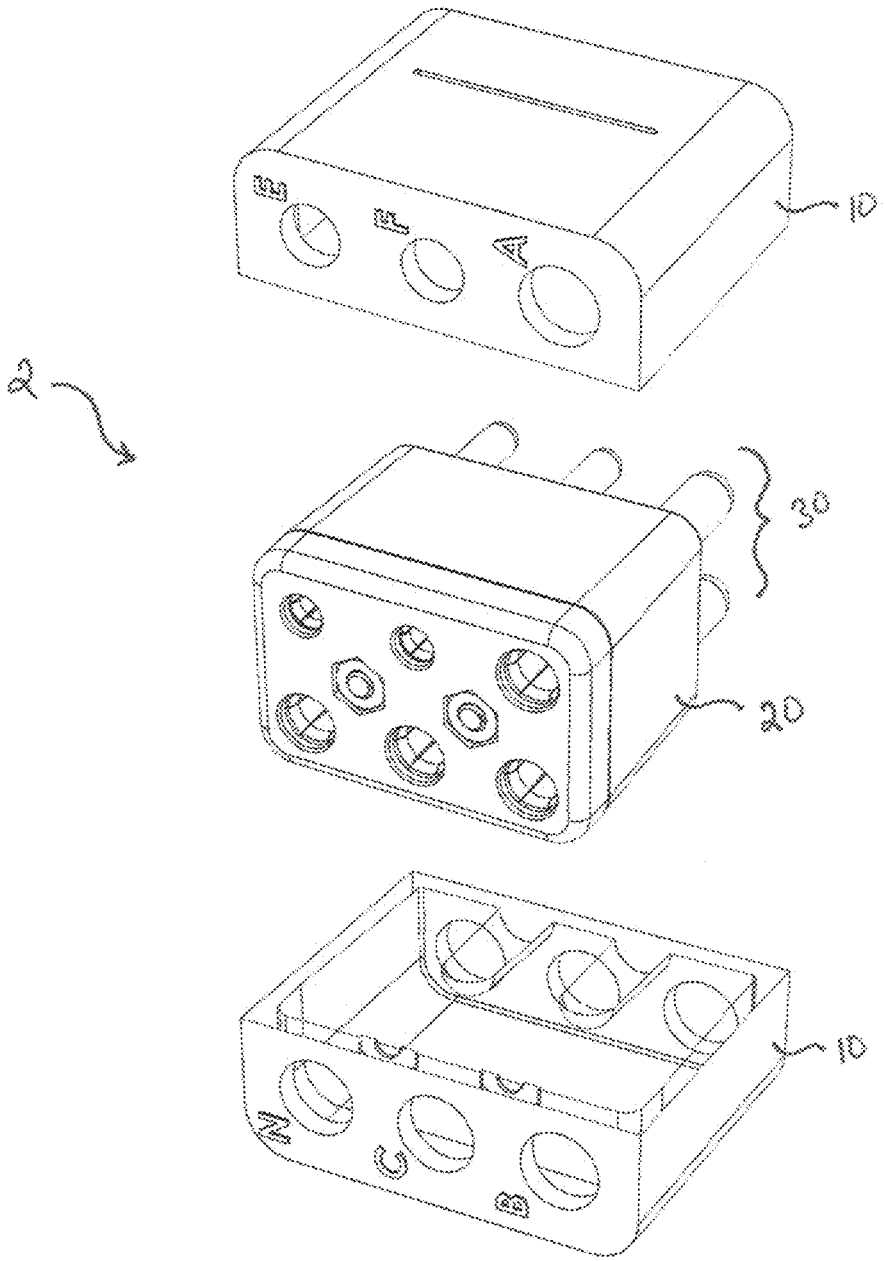
FIG. 1 is a perspective, exploded view of a connector saver having a body, an internal block and a socket group of six sockets.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements.

DETAILED DESCRIPTION

The ground power connectors of the present invention are intended for utilization on airfields and ground power carts. They are to be plugged into external power receptacles on aircraft to connect the aircraft to external sources of electric power. According to one aspect of the invention, a connector saver is added to a standard ground power connector (plug), so that both the connector saver and the standard ground power connector (plug) have the ability to connect to an aircraft fixed connector (receptacle). This is accomplished by a common interface between the connector saver and the standard ground power connector (plug) that mimics the interface of an aircraft fixed connector (receptacle). In other words, the backside of the connector saver, which mates with the standard ground power connector (plug), has the same structure as that of an aircraft fixed connector (receptacle).

According to various aspects of the present invention, embodiments of connector savers are disclosed and described with reference to FIGS. 1 through 8.

An exploded perspective view of a connector saver 2 is shown in FIG. 1. The connector saver 2 has a body 10, an internal block 20, and a socket group 30. In an assembled configuration, the socket group 30 is positioned within the internal block 20, and the assembled internal block is positioned within the body 10. In certain embodiments, the body 10 is a molded synthetic rubber outer shell that is molded around the internal components.

Figure 2:
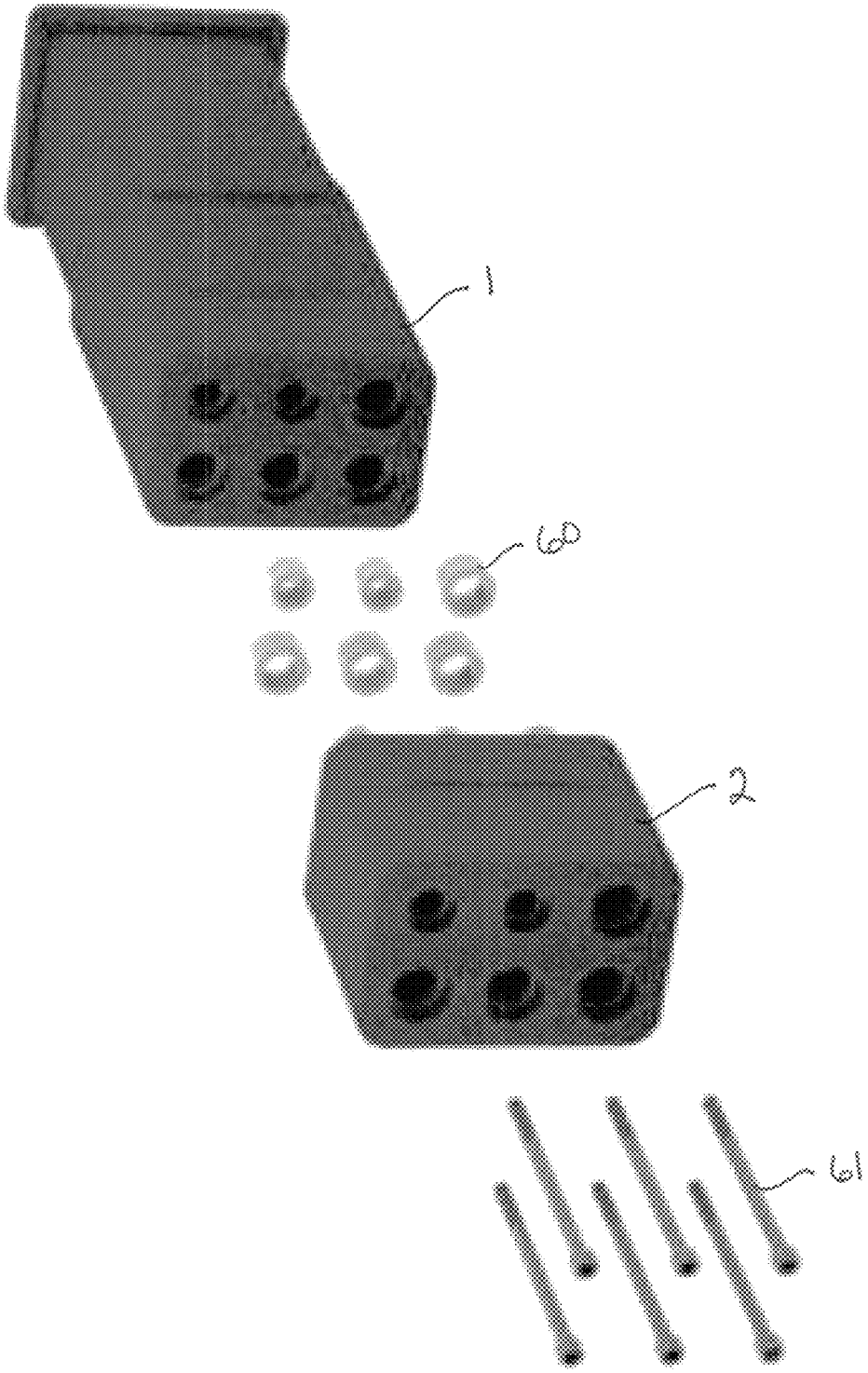
FIG. 2 is an exploded perspective view of a connector saver, contact seals and a ground power connector (plug).

FIG. 2 provides a perspective, exploded view of a ground power connector (plug) 1 and a connector saver 2. As described more fully below, the connector saver 2 may be mounted or assembled to the ground power connector (plug) 1 by inserting male pin contacts of the socket group into the female tyne sections of the sockets of the ground power connector (plug) 1. Once mounted or assembled on the end of the ground power connector (plug), the connector saver 2 serves as the plug for insertion into an aircraft fixed connector (receptacle).

Figure 3A:
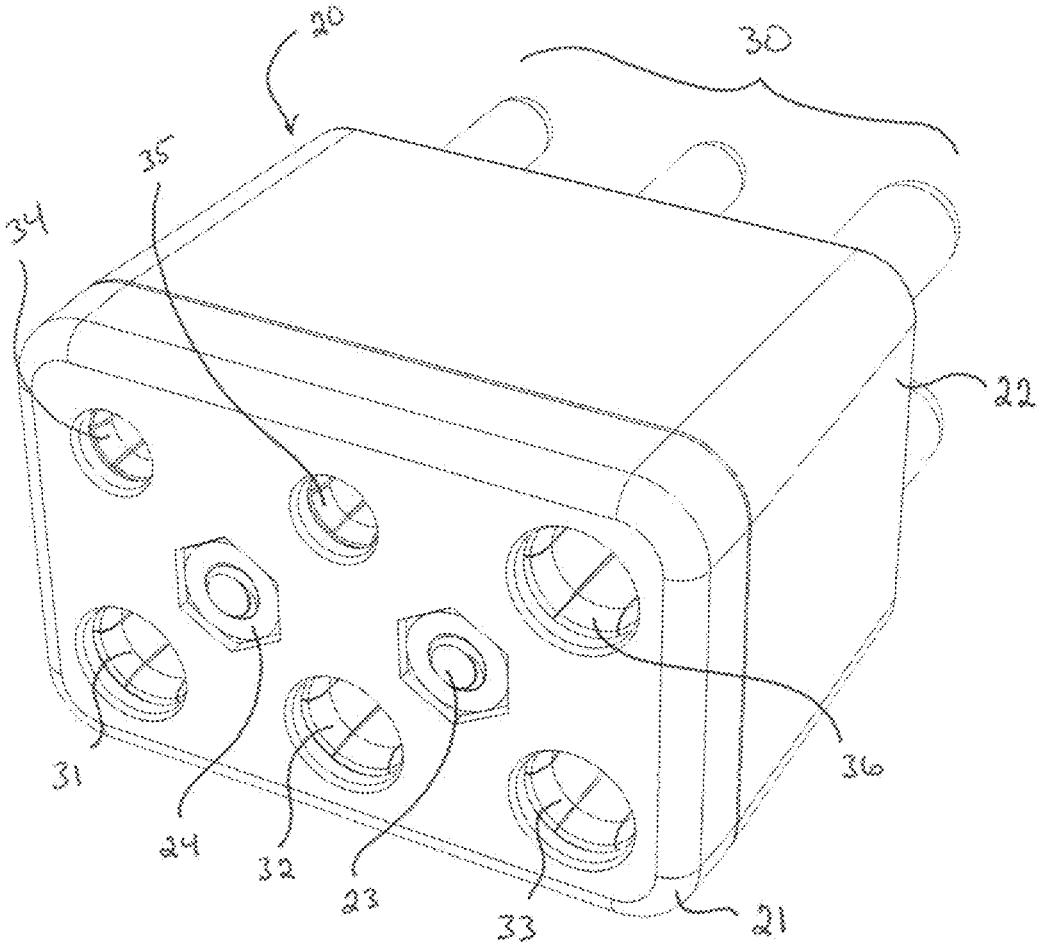
FIG. 3A is a perspective view of an internal block having a face section and a body section, wherein a group of six female sockets are inserted into six cavities in the internal block.

FIGS. 3A through 3G illustrates various views of the internal block 20 and socket group 30 shown in FIG. 1. FIG. 3A is an assembled perspective view of the internal block 20 and socket group 30. The internal block 20 has a face section 21 and a body section 22. These two sections are held together by two bolts 23 and nuts 24. The internal block 20 has cavities that extend through both the face section 21 and the body section 22 for housing individual sockets of the socket group 30. In particular, there are cavities for housing each individual socket, including: socket "N" 31, socket "C" 32, socket "B" 33, socket "E" 34, socket "F" 35, and socket "A" 36. The cavity shape allows the sockets to float and take a preferential alignment to an out-of-position mating pin.

Figure 3B:
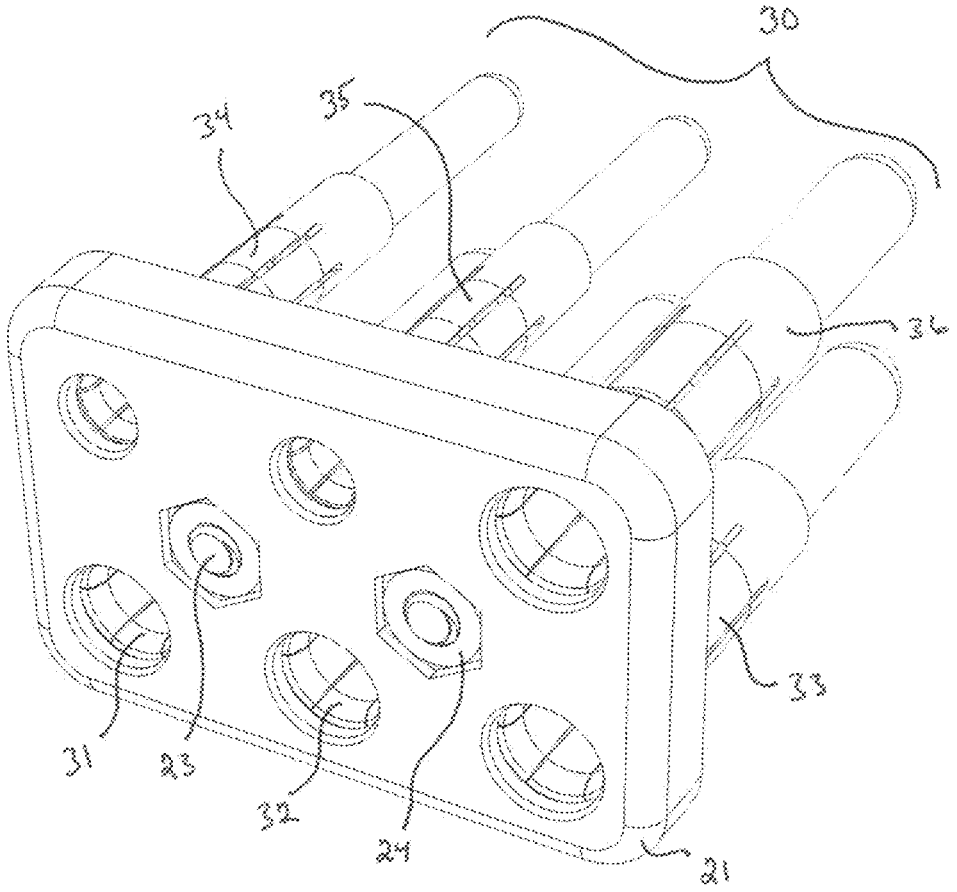
FIG. 3B is a perspective view of the internal block of FIG. 3A, wherein the body section is removed to expose the sockets.

FIG. 3B is a perspective view of the internal block 20 shown in FIG. 3A, except that the body section 22 of the internal block 20 is not shown. As shown, each of the sockets in the socket group 30 are positioned relatively parallel to each other within the internal block 20. The holes in the face section 21 of the internal block are positioned relative to each other so as to correspond to the positions of male contact pins of an aircraft fixed connector (receptacle).

Figure 3C:
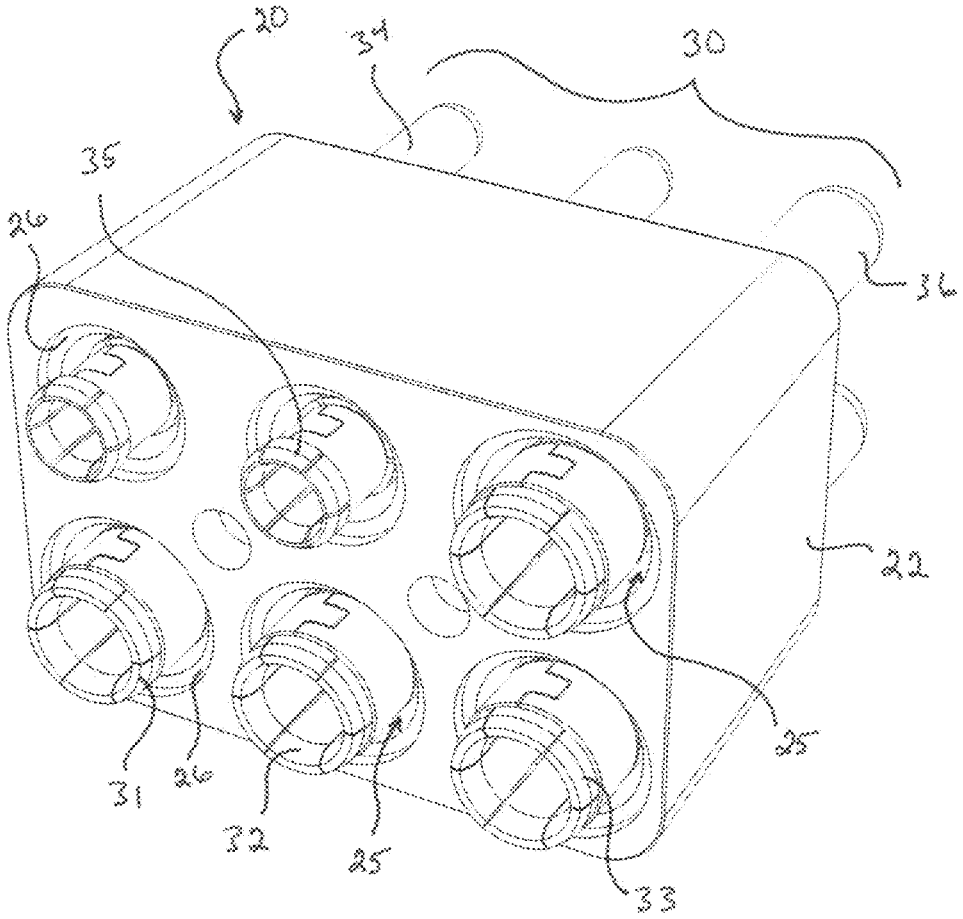
FIG. 3C is a perspective view of the internal block of FIG. 3A, wherein the face section is removed to expose tyne sections of the sockets.

FIG. 3C is a perspective view of the internal block 20 and socket group 30 shown in FIG. 3A, except that the face section 21, nuts 24, and bolts 23 are hidden or removed. The individual sockets 31 through 36 are shown protruding from cavities 25 extending through the body section 22 of the internal block 20. The inside diameters of the cavities 25 are larger than the outside diameters of the sockets 31 through 36 so that an annulus is defined around each of the sockets 31 through 36 such that the center position of the socket can float from the center position of the entrance hole of the front of the block. Further, each of the cavities 25 in the body section 22 have a counter-sink 26 for a receiving annular flanges 27 that extend from the back of the face section 21 (see FIG. 2E).

Figure 3D:
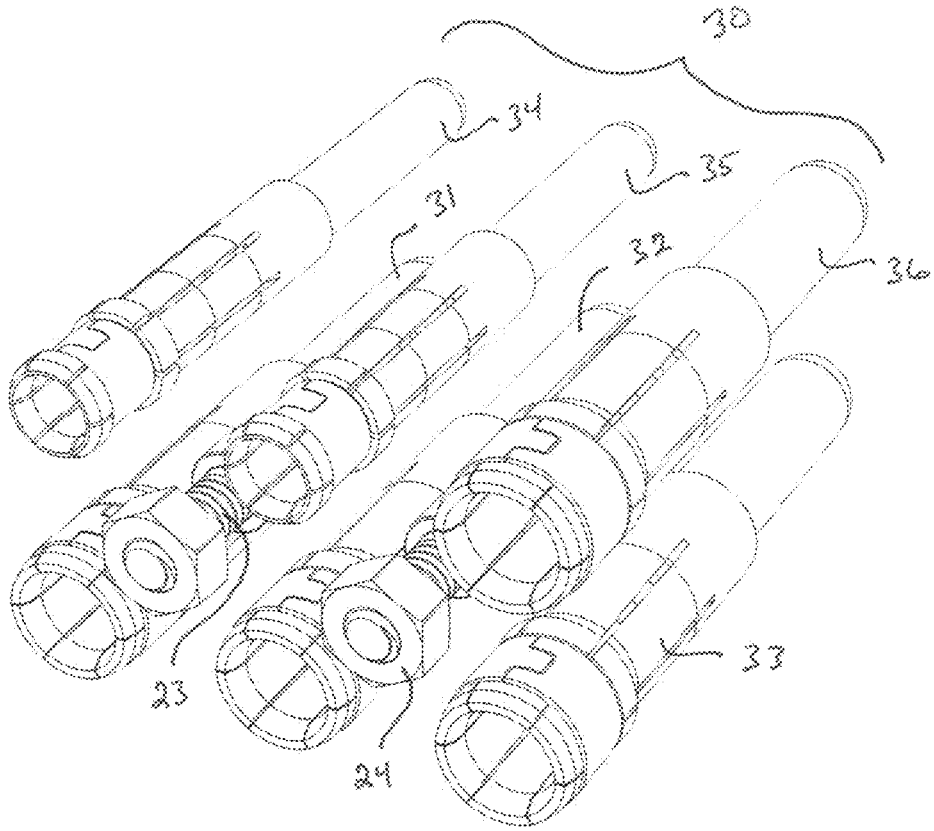
FIG. 3D is a perspective view of the socket group of FIG. 3A, wherein the internal block is removed to expose the sockets.

FIG. 3D is a perspective view of a socket group 30 and the nuts 24 and bolts 23 that arc used to fasten the face section 21 and body section 22 of an internal block 20, not shown.

Figure 3E:
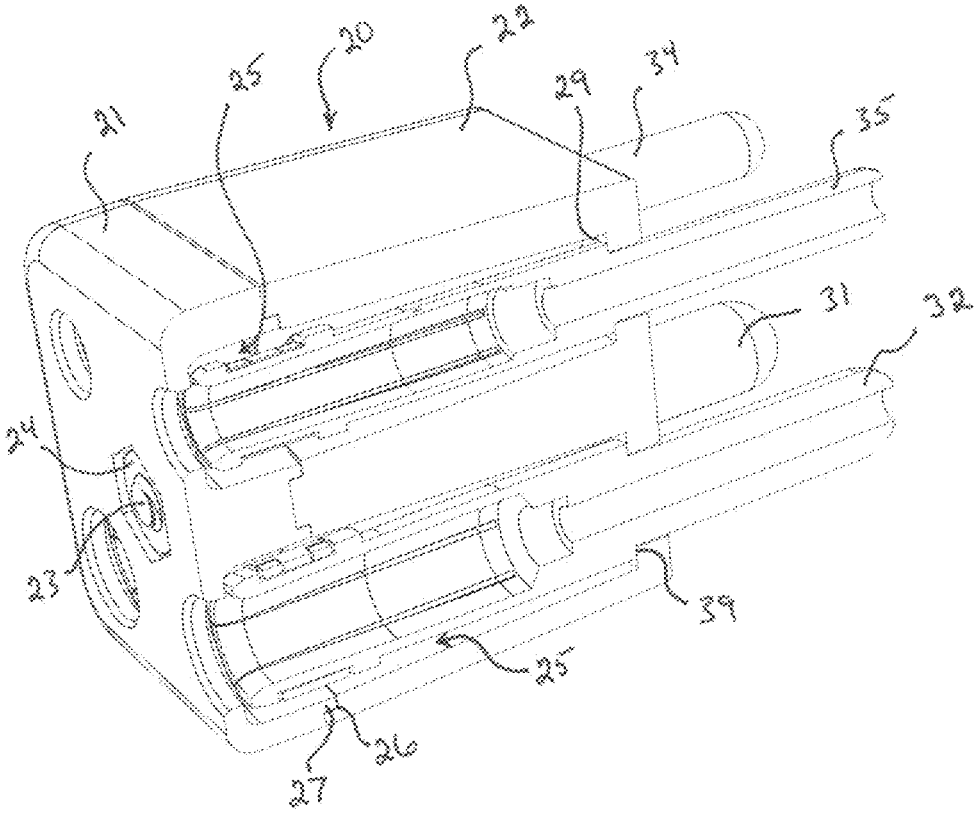
FIG. 3E is a perspective view of a vertical cross-section of the internal block of FIG. 3A, wherein the view if of the face section of the internal block so that two sockets within two respective cavities are visible.

Referring to FIG. 3E, a perspective, cross-sectional view of the internal block 20 and socket group 30 shown in FIG. 3A is illustrated. The cross-section is taken vertically through the internal block 20 so as to bisect socket "F" 35 and socket "C" 32. In this view, of the interaction between the several different annular flanges 27 and the corresponding counter-sinks 26 are visible. In particular, a secure assembly of the face section 21 to the body section 22 of the internal block 20 is facilitated when the annular flanges 27 securely insert themselves into the corresponding counter-sinks 26. This assembly is further secured by fastening the nuts 24 to the bolts 23. As previously described, a cavity 25 is defined in the internal block 20. The size of the cavity 25 is sufficiently large to allow the socket to move within the cavity 25 so as to align itself with a male contact pin of an aircraft fixed connector (receptacle). In the embodiment shown in FIGS. 3A through 3E, each of the sockets 31 through 36 are positioned within corresponding cavities 25 that are sufficiently large to allow each socket to move transversely therein. Thus, if the male contact pins of an aircraft fixed connector (receptacle) are misaligned relative to each other, so that they are no longer parallel to each other, the individual sockets 31 through 36 align themselves within their respective cavities 25 so as to mate more perfectly with the respective male contact pins. This reduces binding forces which impede mating and unmating and reduces wear on the pins and socket contacts. Further, the sockets 31 through 36 comprise a retention shoulder 39 that engages with a pivot rim 29 to retain the back end of the socket in a stationary position relative to the body section 22 of the internal block 20 while allowing the front end of the socket to move freely within the cavity 25.

Figure 3F:
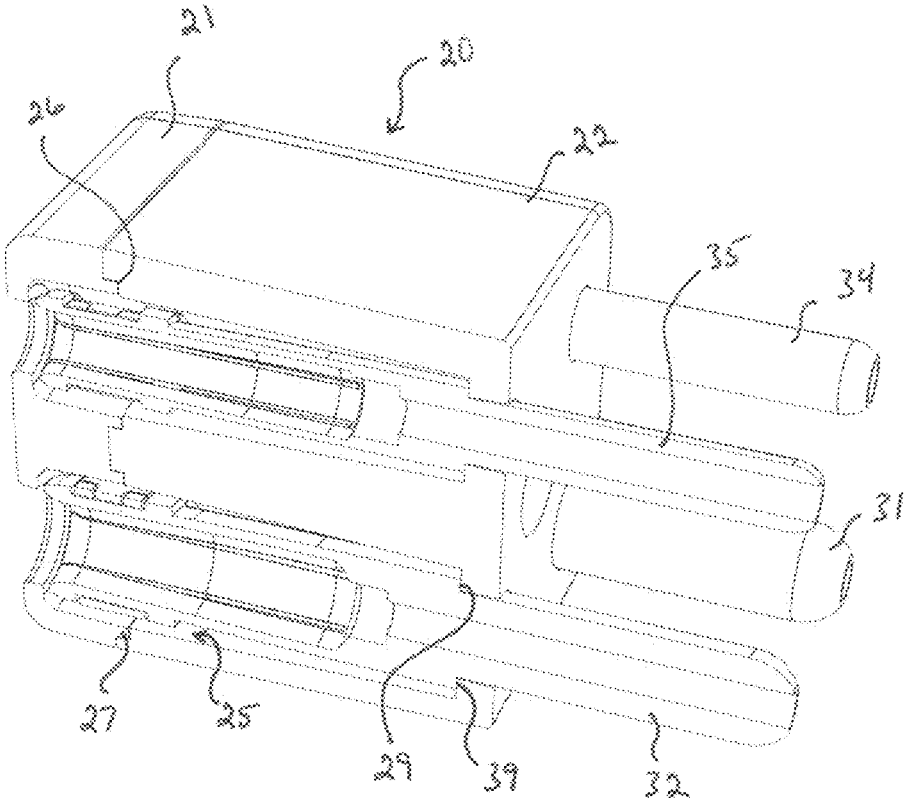
FIG. 3F is a perspective view of a vertical cross-section of the internal block of FIG. 3A, wherein the view if of the body section of the internal block so that two sockets within two respective cavities arc visible.
Figure 36:
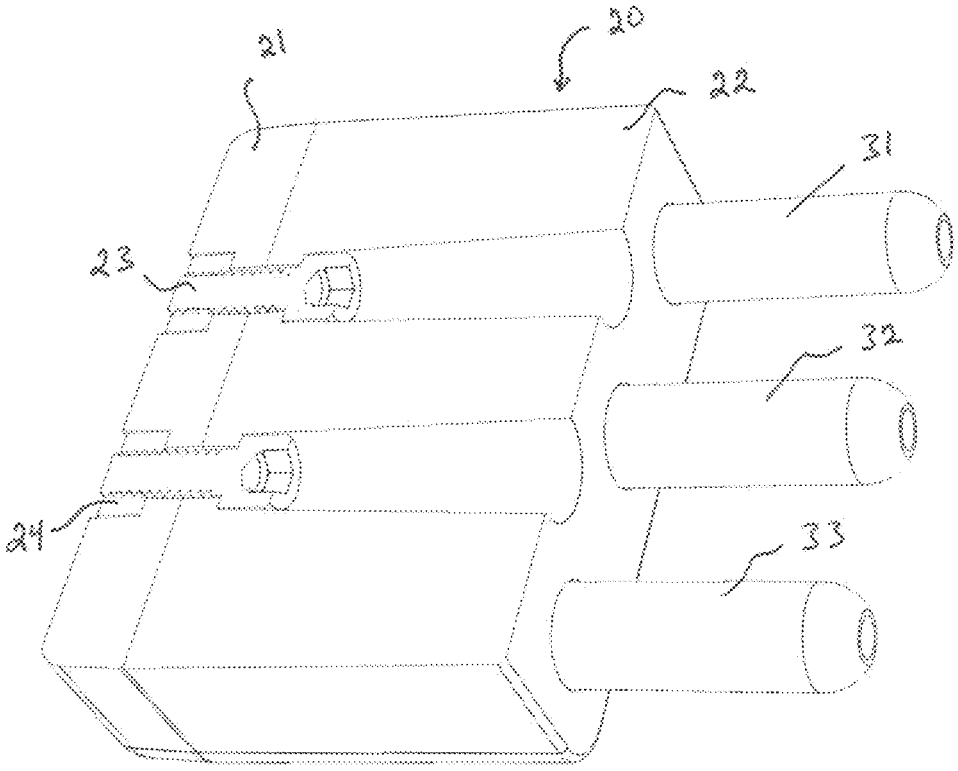

Referring to FIG. 3F, a cross-sectional perspective view of the internal block 20 and socket group 30 illustrated in FIG. 3A is shown. Further, this cross-sectional perspective view of FIG. 3F is similar to that of FIG. 3E except that it is of the backside of the internal block rather than the front side. From this view of FIG. 3F, the interaction between the retention shoulder 39 and the pivot rim 29 of each socket is plainly visible. Further. FIGS. 3E and 3F illustrate how the cavities 25 are tapered, such that the diameter of the cavity 25 at the end nearest the pivot rim 29 is smaller than the diameter of the cavity 25 at the end extending into the face section 21 of the internal block 20. The tapered holes allow the distal ends of the sockets 31 through 36, which extend into the face section 21 of the internal block 20, to move in transverse directions while the proximal ends of the sockets 31 through 36 are held relatively fixed by the annular bevel pivot surface 28. Because these holes are tapered, a two-piece design of the internal block 20 enables construction via molding processes. An internal block 20 constructed of two parts may accommodate draft angles and seal the sockets front and back. The two parts of the internal block 20 may be held together with ½-20 fasteners.

The sockets internal diameters are also tapered but in the opposite direction as the cavities in the integral block. When a bent pin engages, it pushes the front of the socket to the side but as it is engaged, the off center pin has room inside the back of the socket so that the tip of the pin does not rub against the inside diameter of the socket. This accommodation may be needed because the rear of the socket, especially for the plugs, is fixed by the socket to rear of the internal block by virtue of the chamfered edges. The combination of the tapered cavities of the core block and the reverse taper of the sockets may allow uniform tolerance for the entire mating length.

FIG. 3G is a cross-sectional perspective view of the top of the internal block 20 and socket group 30 of FIG. 3A, wherein the cross section is taken horizontally across the two nuts 24 and bolts 23. Because this is a top perspective view, only sockets 31 through 33 are visible. The face section 21 is connected to the body section 22 by the bolts 23 and nuts 24 to form the internal block 20.

Figure 4A:
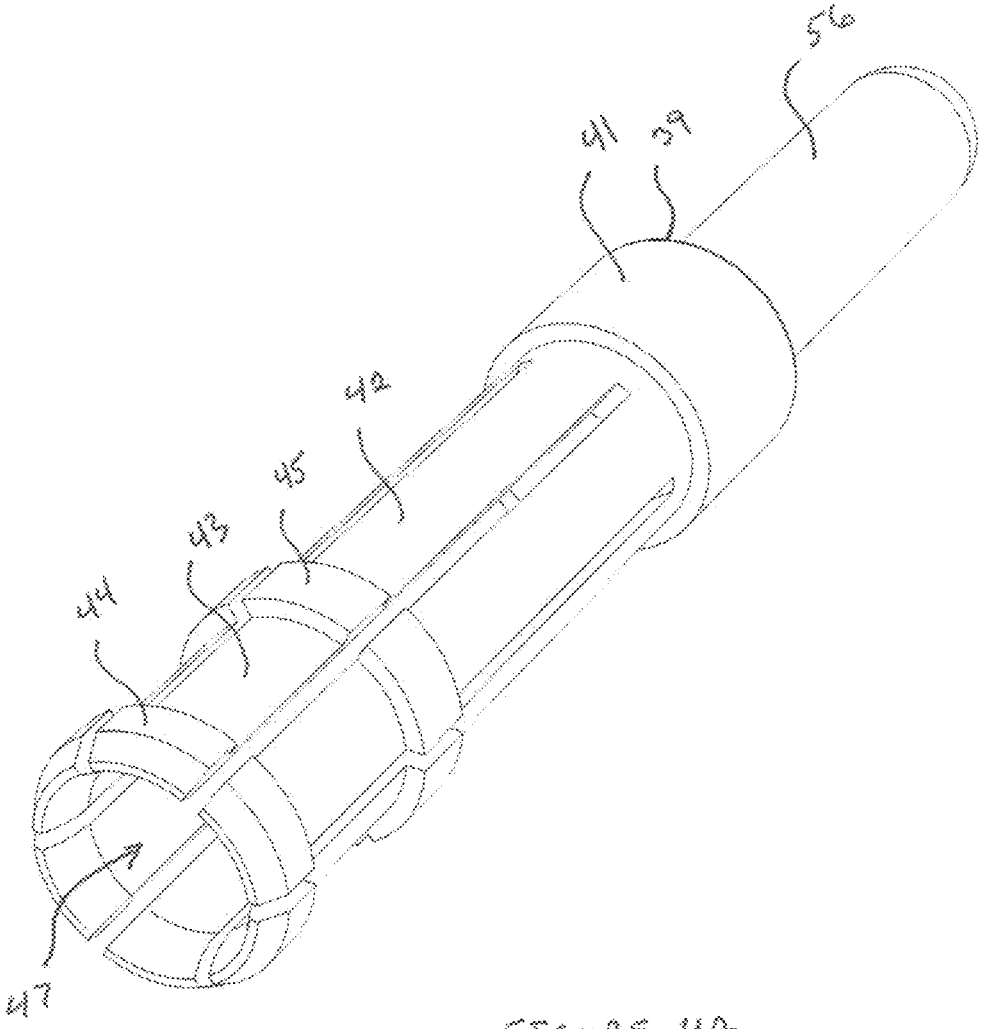
FIG. 4A is a perspective view of a female socket having a barrel section and a tyne section, wherein the female socket has six tynes.

FIG. 4A illustrates a perspective view of one of the sockets of the socket group 30 shown in FIGS. 1 through 3G. The socket comprises a barrel section 41, a tyne section 42, and a male pin contact 56. In the illustrated embodiment, the tyne section 42 comprises six different tynes that extend in a longitudinal direction from the barrel section 41 of the socket. The tynes from an opening 47 at their distal ends. Because the tynes in the tyne section 42 are only attached at their proximal ends to the barrel section 41, the tynes, at their distal ends, are free to flex in radially transverse directions. The tynes of the tyne section 42 also comprise a retention section 43 defined between a distal flange 44 and a proximal flange 45. An annular retention shoulder 39 is located that the end of the barrel section 41 where the male pin contact 56 extends from the barrel section 41. In one embodiment of the invention, the inside diameter of the sockets is such to allow 0.010 inch off axis in the back of the contact. The contacts may be made of tellurium copper due to its high conductivity, but other high conductive materials are permissible.

Figure 4B:
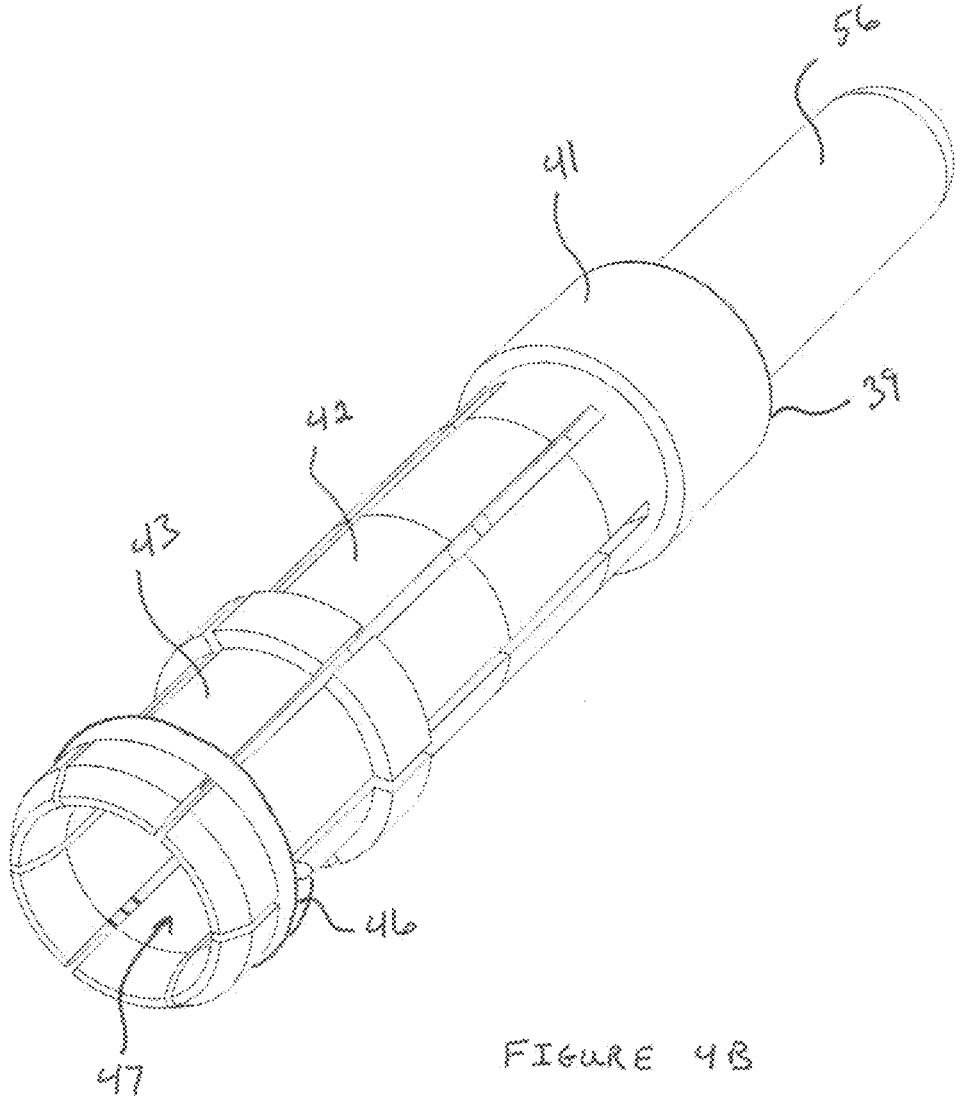
FIG. 4B is a perspective view of the female socket of FIG. 4A, wherein a circumferential spring is assembled to the tynes.

FIG. 4B is a perspective view of the socket shown in FIG. 4A. A circumferential spring 46 may be added to the distal ends of the tynes in the retention section 43 between the distal flange 44 and the proximal flange 45. The circumferential spring 46 encircles all of the tynes in the tyne section 42 and forces the tynes to bend or flex in radially transverse inward directions toward each other to reduce the size of the opening 47. By selecting a circumferential spring 46 that has a desired resilience, the socket may be engineered to apply a selected mating force with a male contact pin of an aircraft fixed connector (receptacle). Spring wire thickness, elasticity, and the number of springs control the forces. A relatively stronger circumferential spring 46 will apply relatively stronger mating forces. In alternative embodiments, a plurality of circumferential springs 46 may be applied to a single socket. For example, four relatively smaller circumferential springs may be used to apply the same mating force as a single relatively larger circumferential spring. Sockets comprising a single circumferential spring may be cheaper to manufacture because it may take longer to apply multiple springs.

Different embodiments of the invention may have sockets that have different numbers of tynes. For example, each socket may have any number of tynes, for example, between two and ten tynes. Sockets with three, four or six tynes have been tested. Sockets with six tynes have been shown to have more front end compliance than the socket with three tynes. Further, development testing has shown that sockets with six tynes follow offset pins with relatively minimal increases in engagement forces. In particular, when an offset of 0.020 inches was tested, sockets with three tynes had forces that nearly doubled compared to forces without an offset. For sockets with six tynes, the forces observed with an offset of 0.020 inches stayed about the same as the forces without an offset. We have found that using six tynes instead of the typical three or four gives one more flexibility to the contact that allows the contact to accommodate out of position, out of round or bent pins. It also provided more force uniformity while mating and unmating.

Figure 4C:
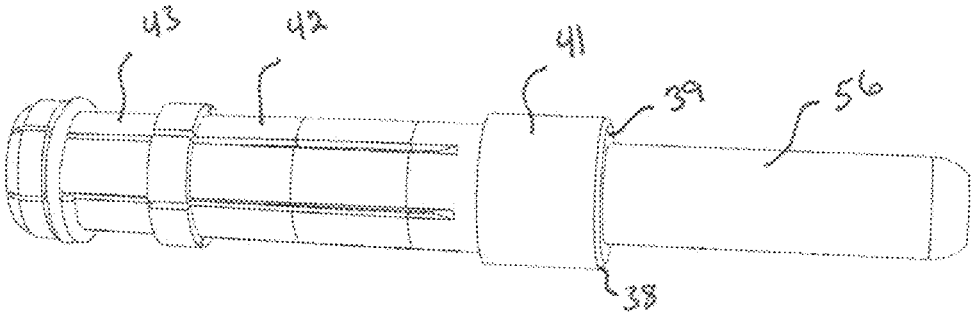
FIG. 4C is a side view of the female socket of FIG. 4A, wherein a pivot shoulder is visible.

FIG. 4C is a perspective side view of the socket shown in FIGS. 4A and 4B. As previously noted, each socket comprises a retention shoulder 39. The retention shoulder 39 comprises a chamfer pivot surface 38. From the view shown in FIG. 4C, the chamfer or rounded corner of the chamfer pivot surface 38 is more readily visible.

Figure 5A:
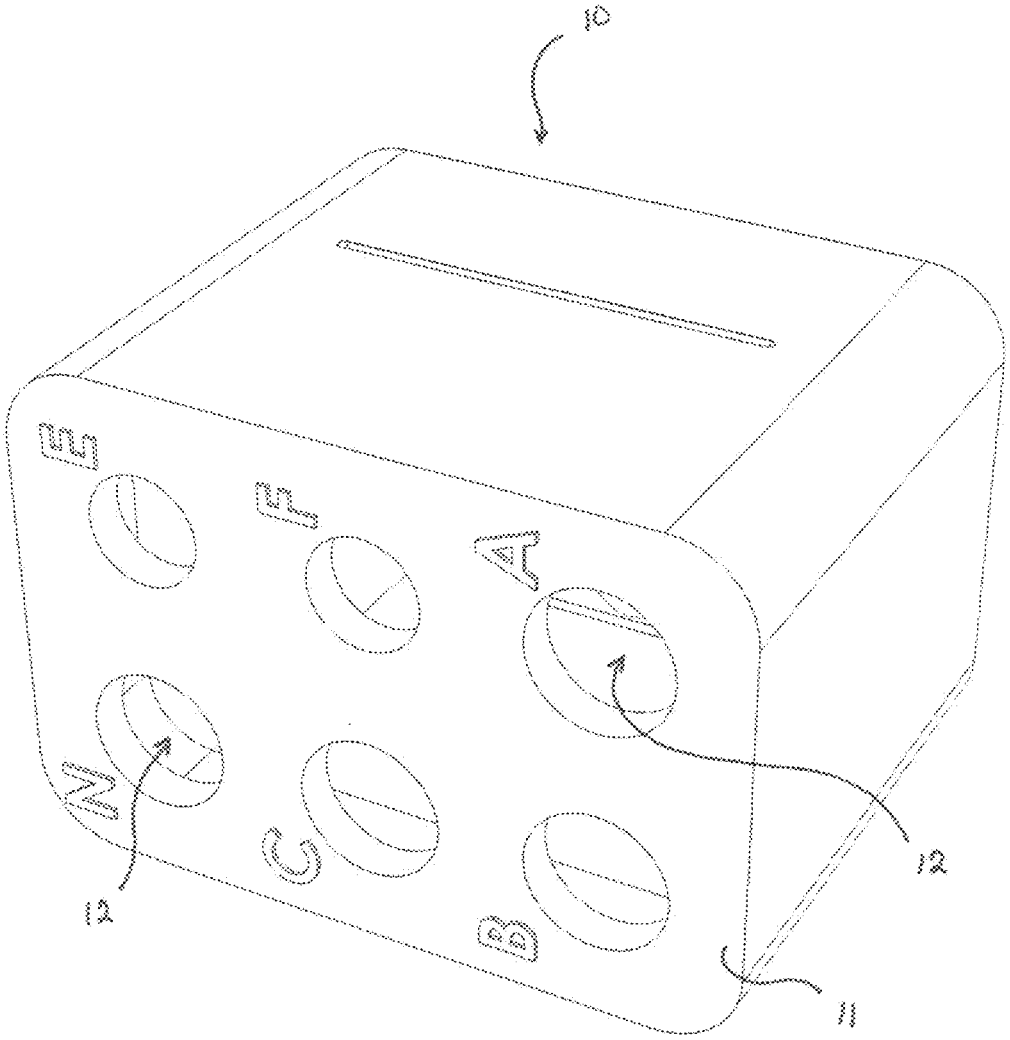
FIG. 5A is a perspective view of a body 10 having six openings for access to six female sockets.
Figure 5B:
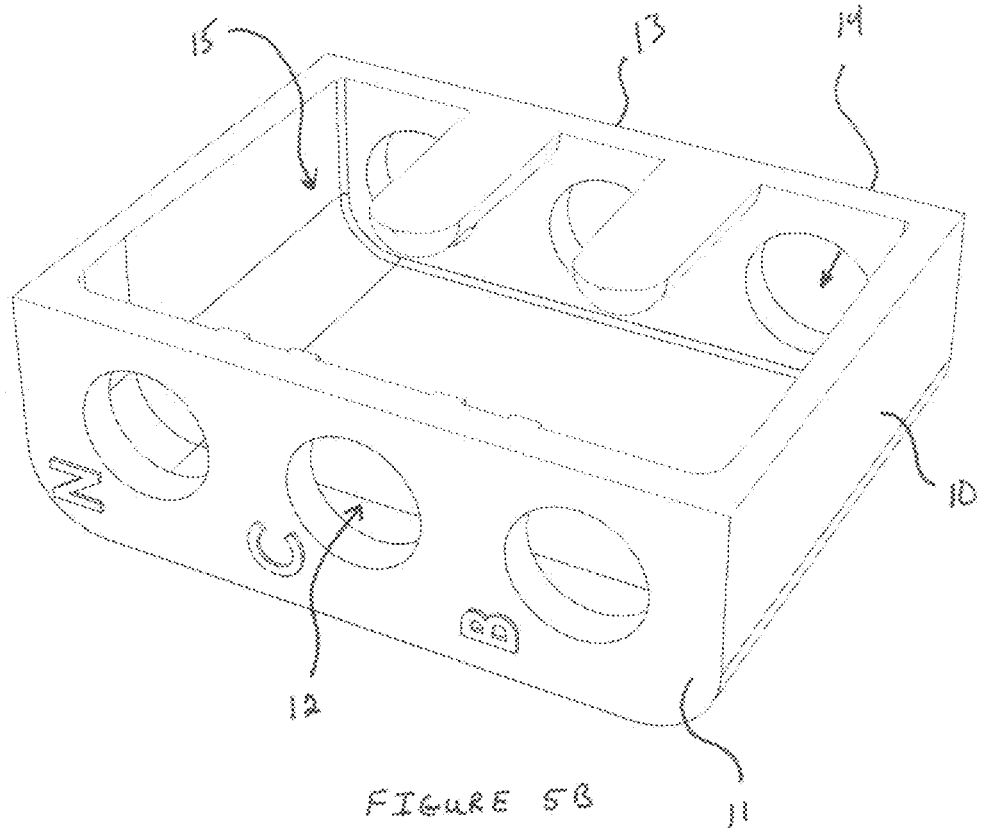
FIG. 5B is a perspective view of a horizontal cross section of the body 10 of FIG. 5A, wherein a void space for an internal block is visible.
Figure 5C:
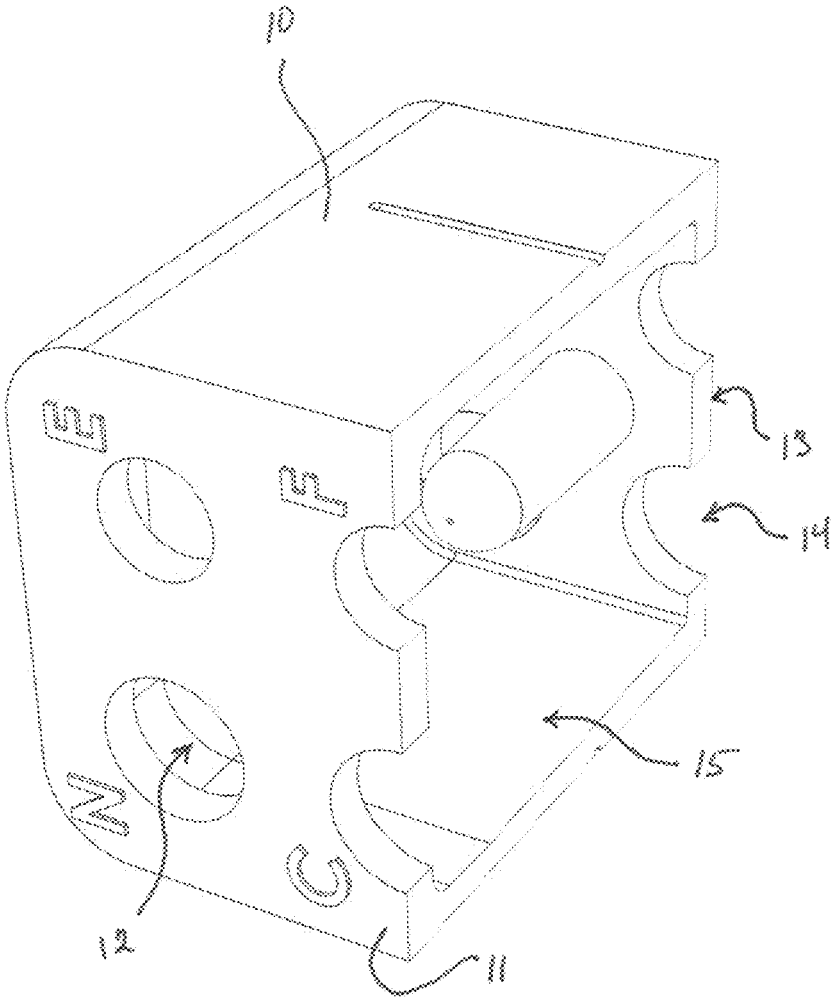
FIG. 5C is a perspective view of a vertical cross section of the body 10 of FIG. 5A, wherein a void space for an internal block is visible.

Referring to FIG. 5A, a perspective view of a body 10 is illustrated. The body 10 may be a unitary molded synthetic rubber structure for housing the internal block 20 and the socket group 30, not shown. The exterior of the body 10 is configured in size and shape so as to mate with an aircraft fixed connector (receptacle) as is standard in the industry. FIG. 5B is a perspective view of a horizontal cross-sectional of the body 10 shown in FIG. 5A. In this view, a void space 15 is revealed to show where the internal block 20, not shown, is to be positioned within the body 10. FIG. 5C is a perspective view of a vertical cross-sectional view taken along a vertical plain to the middle of the body 10. This figure shows the body 10 as illustrated in FIGS. 5A and 5B. This cross-sectional view also shows the internal void space 15 where the internal block 20 in socket group 30 is to be positioned within the body 10. At a front face 11 of the body 10, openings 12 are provided to give access to each of the sockets 31 through 36 when the socket group and internal block 20 are assembled inside the body 10. At a back face 13 of the body 10, openings 14 are provided so that the male pin contacts 56 of the sockets 31 through 36 may extend through the openings 14 when the socket group and internal block 20 are assembled inside the body 10.

Figure 6A:
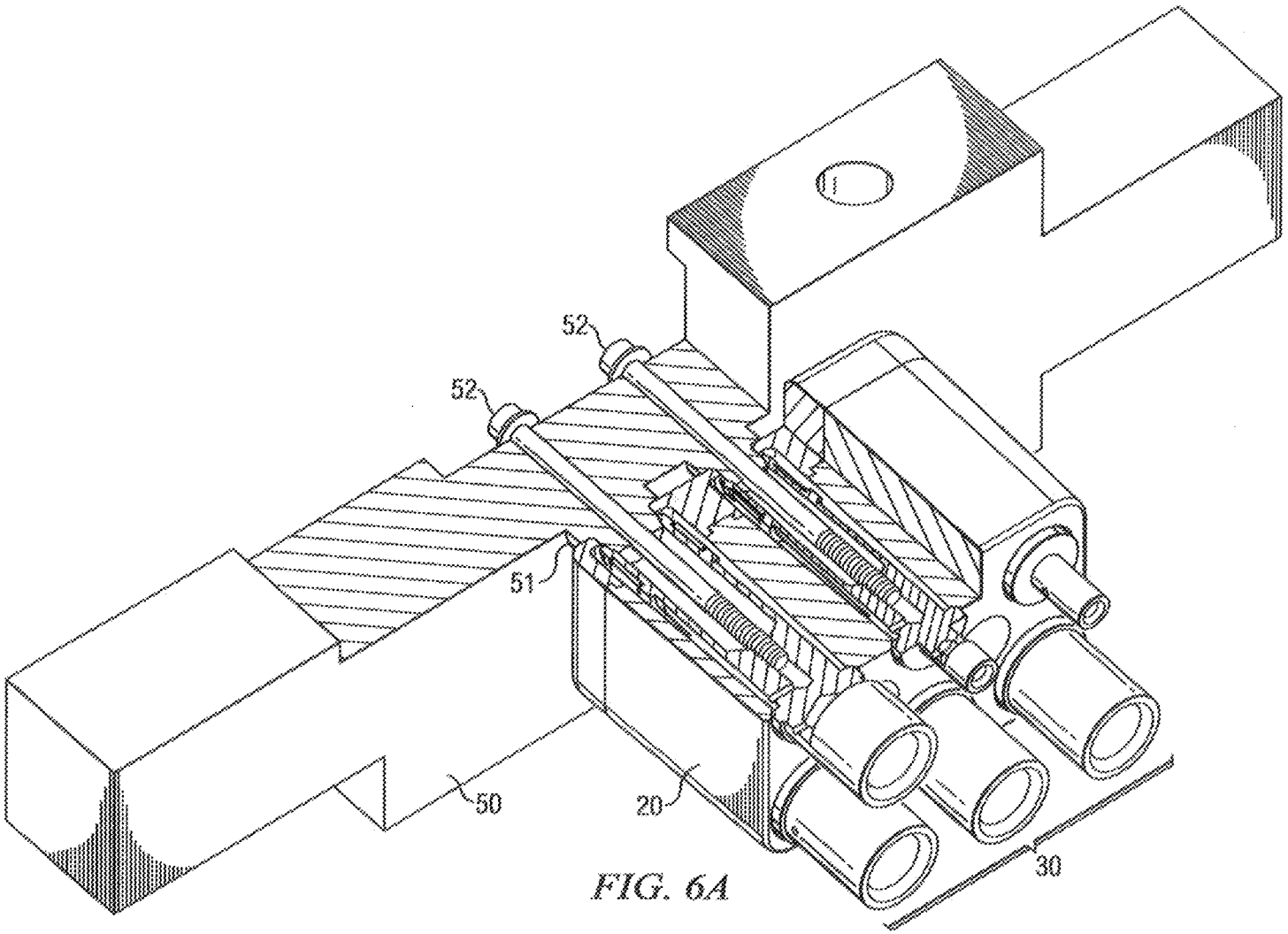
FIG. 6A is a perspective view of an arbor with an internal block mounted thereon for molding a body 10 to the internal block, wherein the socket group and the internal block are fastened to the arbor by COTS screws that are threaded into the sockets. These views are of an internal block for a plug and not a connector saver. The connector saver is similar but has a back arbor like the front and uses a different rear block and contacts.

According to one aspect of the invention, the body 10 may be molded over the internal block 20 and socket group 30. The body 10 may comprise chlorosulfonated polyethylene rubber, or synthetic rubber. As shown in FIG. 6A, the body 10 may be molded by first securing the socket group 30 and the internal block 20 to an arbor 50. However the molding process is the same for a connector saver with male pin contacts. The arbor 50 has six nipples 51 that extend through the holes in the face section of the internal block 10 and into the openings 47 of the sockets in the socket group 30. These nipples 51 serve to properly position the internal block 20 and socket group 30 relative to the arbor 50. The nipples may provide a 1.000 inch socket-to-socket spacing during manufacturing. After manufacturing, the front of the sockets are allowed to deviate from the 1.000 inch spaces to align preferentially to an aircraft receptacle, even if it is slightly damaged. For a plug, the socket contacts of the socket group 30 may be loaded from the back of the internal block 20 and pulled into and against the internal block 20 with 8-32 screws 52 introduced from the front of the arbor 50. For the connector saver, the screws go through the contacts and engage a rear arbor that is similar to the front. Common COTS screws 52 extend through the arbor 50 and thread into the barrel sections of sockets of the socket group 30. As the COTS screws 52 are threaded into the sockets, the sockets and the internal block 20 arc pulled toward the arbor 50 until the nipples 51 are fully engaged in the sockets. A body 10 may then be molded over the internal block 20 and socket group 30. The thickness of the molded body 10 over the front of the face section may be at least about 0.100 inches so that no part of any socket nor any part which is electrically connected to any socket may be within about 0.100 inches of the front end of the connector saver. The molded connector saver can be immediately removed from the mold after curing.

Figure 6B:
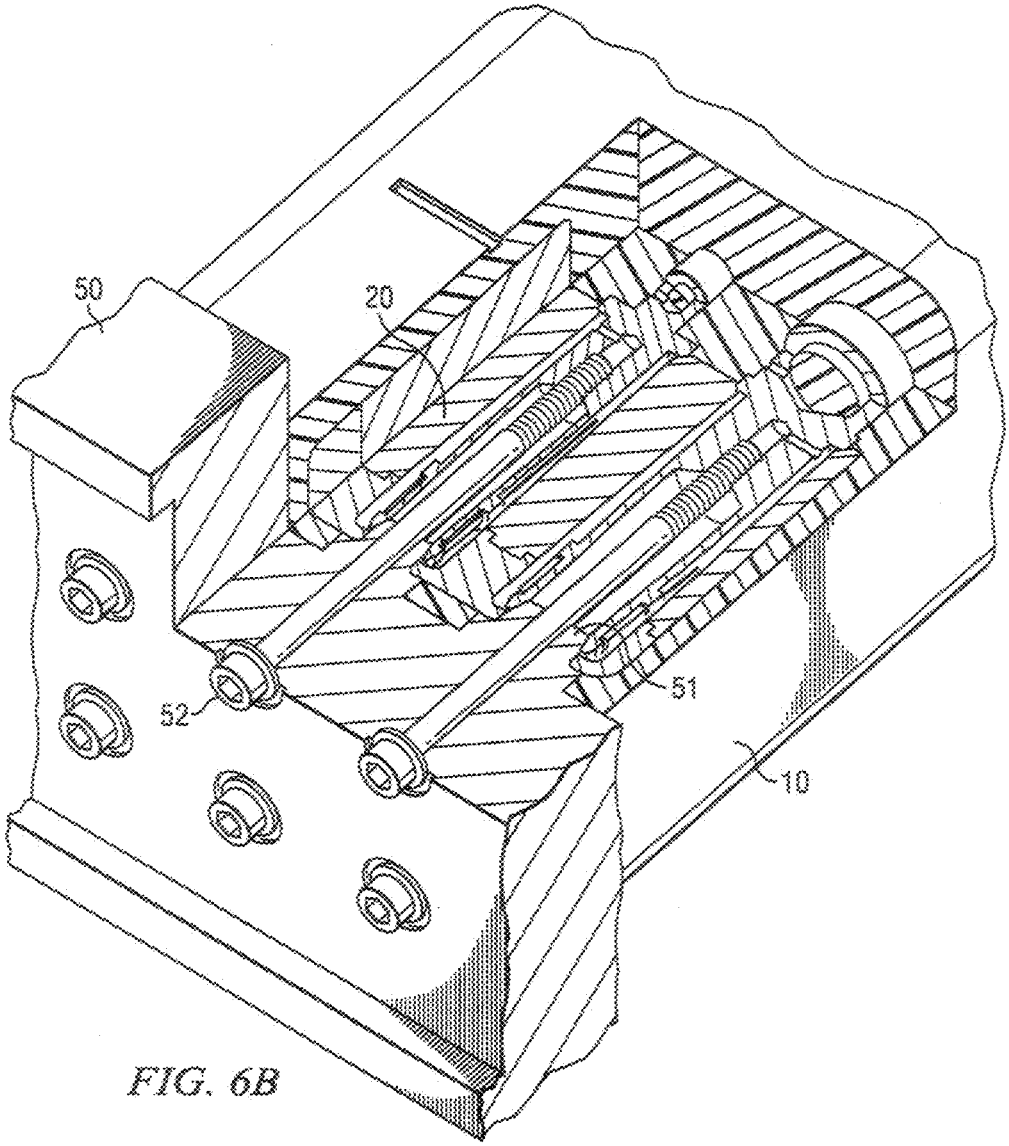
FIG. 6B is a perspective view of a body molded onto an internal block and a socket group, wherein a cut-away exposes cross sections of female sockets in sealed cavities within the internal block, and wherein the view is from the back of the arbor.
Figure 6C:
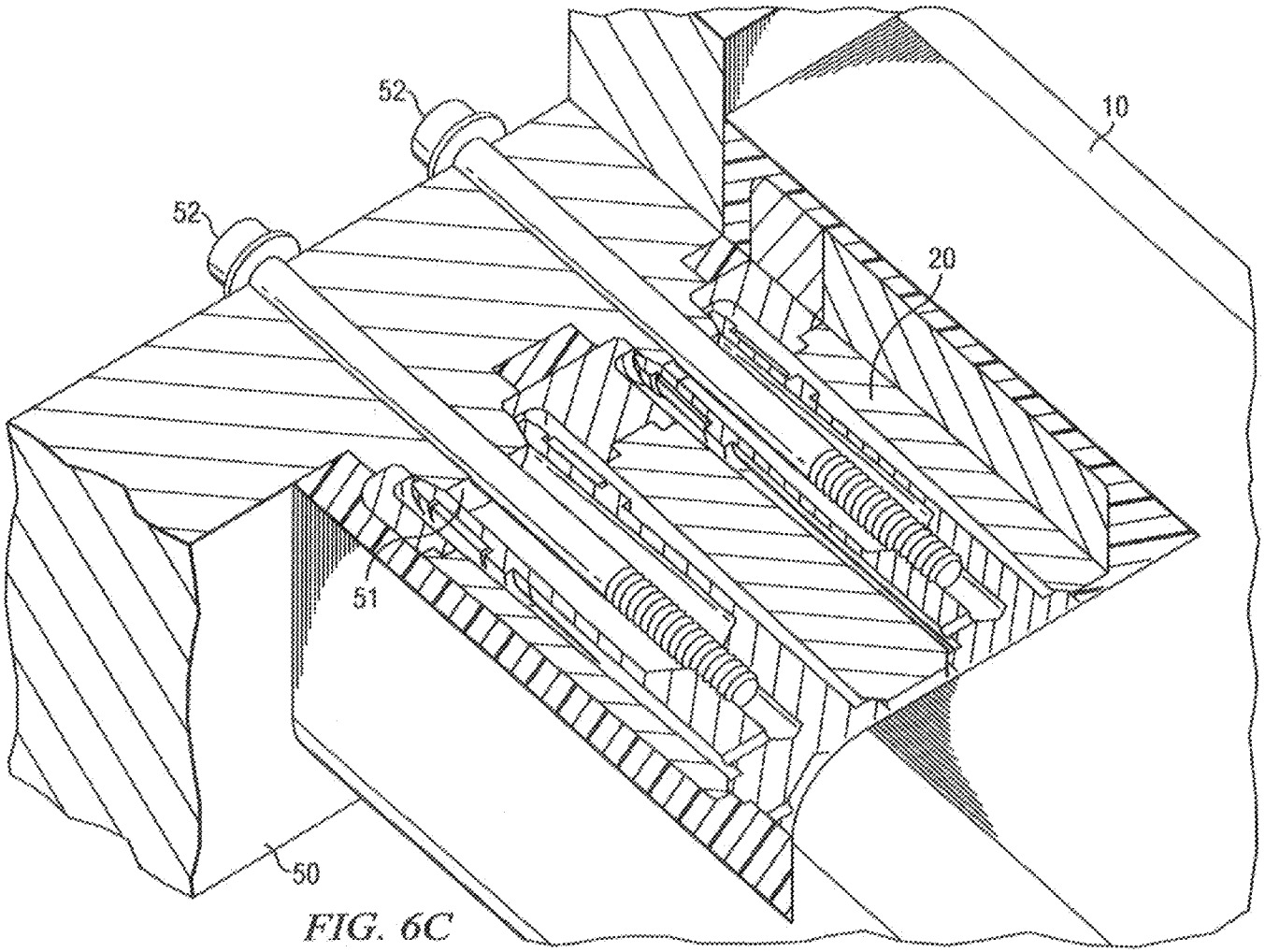
FIG. 6C is a perspective view of the body molded onto an internal block and a socket group of FIG. 6B, wherein the view is from the front of the arbor.

As shown in FIGS. 6A and 6B, the molded body 10 completely encloses the internal block 20 and the socket group 30, except that the nipples 51 preclude any mold material from flowing into the cavities of the internal block 20. The rubber of the body 10 completely encircles the male contact pins 56 to form the back face 13 of the body 10. See FIGS. 1 and 5B. Around the connector saver pin, there is a clearance hole around the pin and the seal fits tightly between this hole and the pin. For the plug, the rubber is molded completely around the back of the sockets and wires. The material comprising the body 10 may be sufficiently flexible to allow small local elastic deformations around the male contact pins 56 to allow the sockets to align with pins of the aircraft fixed connector (receptacle) during engagement/disengagement and seal each pin against fluid ingress that might degrade electrical isolation.

Connector savers may have either molded rubber or other material that could either be molded or machined.

In one embodiment of the invention, the ground power connector (plug) may have power sockets measuring 12 pounds contact force each and relay sockets measuring 9 pounds contact force each. The sum of the 4 power socket contact forces and the 2 relay socket contact forces may then be about 66 pounds. The floating contact design allows custom force connectors to be manufactured, wherein the force is calculated by the sum of the individual socket contact forces, which may be close to the plug/receptacle force.

In a further embodiment, the ground power connector (plug) may have power sockets measuring 24 pounds contact force each and relay sockets measuring 2 pounds contact force each. The sum of the 4 power socket contact forces and the 2 relay socket contact forces may then be about 100 pounds.

The normal acceptable force required to mate the connector saver with its applicable receptacle may be as high as about 50 pounds for three-socket plugs and 100 pounds for six-socket plugs. The force required to remove the connector saver from the receptacle at each point in the first half-inch of travel from the fully engaged position may be about 40-60 pounds for three-socket plugs, and may be about 80-120 pounds for six-socket plugs. The industry standard force required to engage a female socket with a pin contact may be up to about 24 pounds for the A, B, C and N contacts and up to about 2 pounds for the E and F contacts. The industry standard force required to remove a female socket from a male pin contact may be between about 16 to 24 pounds for the A, B, C and N contacts and about 2 pounds for the E and F contacts. The force measurements may be made using a tension/compression tester equipped with a means for measuring or recording lineal displacement versus force. The rate of movement may be about 7-9 inches per minute.

A connector saver 2 of the present invention may be mated or engaged with a ground power connector (plug). Returning again to FIG. 2, a perspective, exploded view of a ground power connector (plug) 1 and a connector saver 2 is provided. Seals 60 are positioned between the ground power connector (plug) 1 and the connector saver 2. An individual seal 60 is positioned over each of the pin contacts 56 so that when the pin contacts 56 are inserted into the sockets 31-36 of the ground power connector (plug) 1, the seals 60 seat themselves inside the openings in the ground power connector (plug) 1 for the connector sockets 31-36. The seals 60 may provide a water-tight seal of the opening in the ground power connector (plug) 1 for the connector sockets 31-36 when the connector saver 2 is assembled to the end of the ground power connector (plug) 1. Saver screws 61 may be inserted into the saver sockets 71-76, through the pin contacts 56, and into the connector sockets 31-36 of the ground power connector (plug) 1. The saver screws 61 may be threaded into the connector sockets 31-36, similar to the way the COTS screws were done to secure the internal block to the arbor. (See FIG. 6A). The saver screws 61 securely fasten the connector saver 2 to the ground power connector (plug) 1 and they provide very reliable electrical connections between the pin contacts 56 and the connector sockets 31-36.

Figure 7:
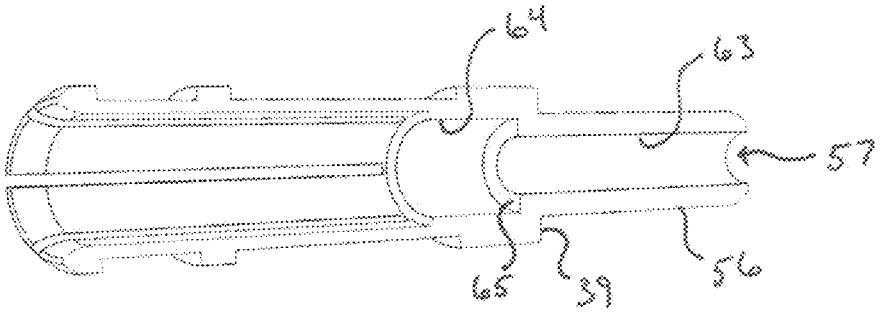
FIG. 7 is a cross-section, perspective view of a socket having a tyne section and a male pin contact, wherein an internal passage is visible.

Referring to FIG. 7, a cross-sectional, perspective view of a connector saver socket of the socket group 30 (see FIG. 1) is illustrated. A passageway 57 through the interior of the pin contact 56 is visible. The passageway 57 has a narrow section 63 and a wide section 64 separated by an annular shoulder 65. The sizes of these structures may be such to allow the head of the saver screw 61 (see FIG. 2) to land on the annular shoulder 65. When the saver screws 61 are threaded into the sockets of the ground power connector (plug) 1, socket self-alignment may be facilitated by not over-tightening the saver screws 61. Placement of the annular shoulder 65 near the pivot shoulder 39 may further facilitate socket pivot, whereas if the annular should 65 and pivot shoulder 39 are spaced relatively further apart along the longitudinal central axis of the socket, the two points of contact may restrict socket pivot. Thus, even if the saver socket is securely fastened to a plug socket via a saver screw 61, the tyne section 62 of the saver socket may still move within a cavity 25 of the saver internal block 20 to self-align with pins of an aircraft fixed connector (receptacle). The connector saver pins actually rattle inside and are free to move rotationally, angularly, and transversely.

Figure 8:
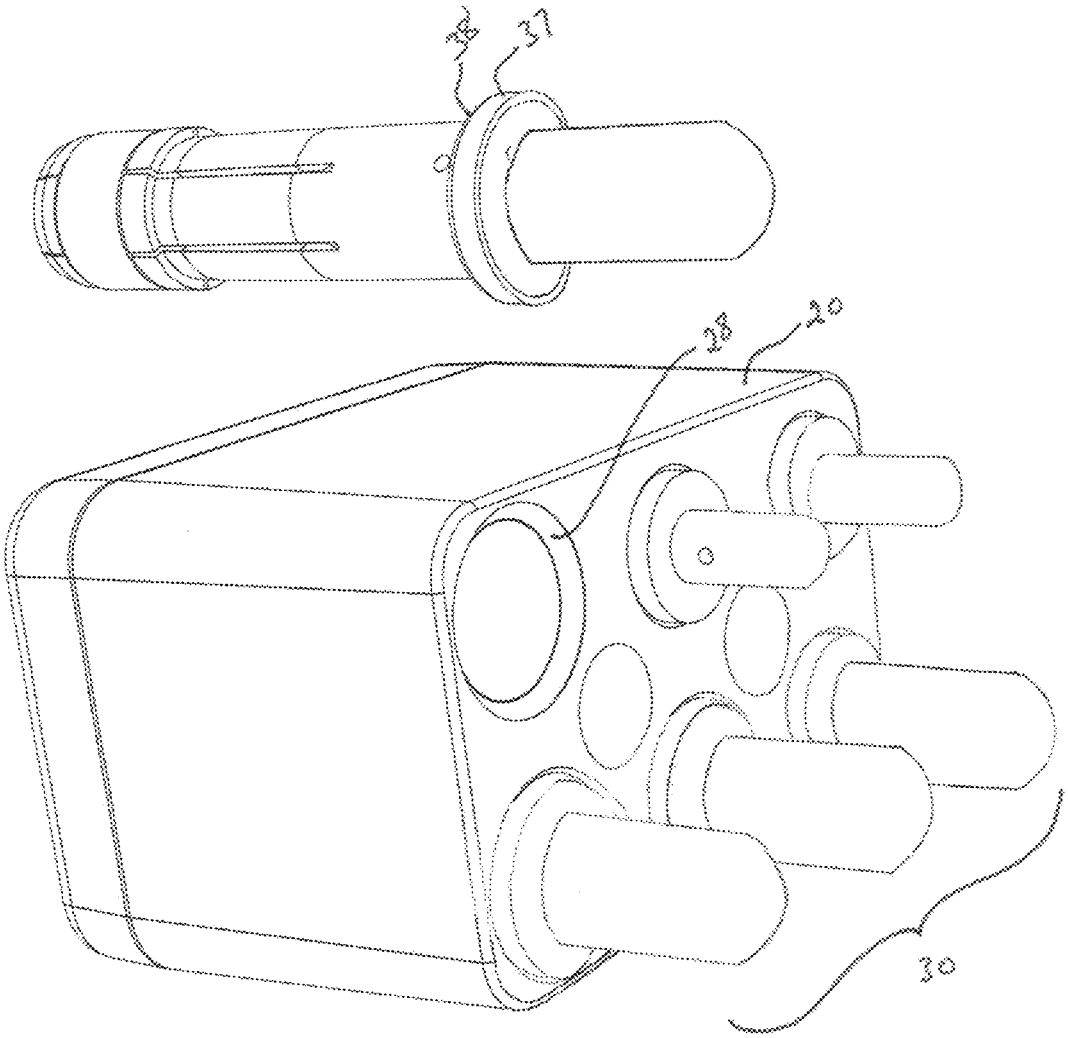
FIG. 8 is an exploded perspective view of a connector saver with a socket removed to illustrate an alternative embodiment having an annular bevel pivot surface and a annular pivot flange.

An alternative embodiment of an interface for allowing a socket to pivot within a cavity is illustrated with reference to FIG. 8. This figure is a perspective view of an internal block 20 and a socket group 30. One of the sockets is removed from the internal block in exploded view. In this embodiment, the internal block 20 has an annular bevel pivot surface 28 and the sockets each have an annular pivot flange 37. The annular pivot flange 37 may also have a chamfer pivot surface 38 for engaging with the annular bevel pivot surface 28 of the internal block 20. In this embodiment, the body 10 (not shown) may be molded over the annular pivot flanges 37 of the sockets to resiliently hold the socket in the internal block while still providing sufficient flexibility to allow the sockets to self-align.

According to one aspect of the invention, the internal block 20 of the connector saver 2 may be a different color than the body 10 so that when the saver body 10 becomes worn, the internal block 20 may be more clearly visible through holes in the saver body. By being different colors, the connector saver may provide a visual indication when the connector saver is worn out and ready for replacement or refurbishment.

In further embodiments of the invention, an internal block is completely omitted and the body is molded or otherwise machined to include the cavities and pivot points for the sockets as described herein. In these embodiments, the internal block and body are essentially formed as a single, unitary structure.

Although the inventions are described with reference to preferred embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

Although the disclosed embodiments are described in detail in the present disclosure, it should be understood that various changes, substitutions and alterations can be made to the embodiments without departing from their spirit and scope.

What is claimed is:

1. A ground power connector saver for electrically and mechanically connecting a ground power connector to an aircraft fixed connector, the connector saver comprising:

a connector saver body;

a socket group positioned partially within the connector saver body, wherein each socket comprises a female tyne section and a male pin contact, wherein the male pin contacts of the socket group have a configuration similar to the aircraft fixed connector; and at least one screw that fastens the connector saver to the ground power connector, wherein the at least one screw extends through at least one male pin contact.

2. The ground power connector saver as claimed in claim 1, further comprising an internal block positioned within the connector saver body and comprising cavities, wherein the sockets of the socket group are positioned within cavities in the internal block.

3. The ground power connector saver as claimed in claim 1, wherein the male pin contacts of the sockets of the socket group are flexibly connected to the female tyne sections.

4. The ground power connector saver as claimed in claim 1, wherein the male pin contact of the sockets of the socket group comprise an annular shoulder, wherein the annular shoulder facilitates pivoting of the socket group.

5. The ground power connector saver as claimed in claim 1, wherein the connector saver body comprises a molded rubber.

6. The ground power connector saver as claimed in claim 1, wherein the connector saver body comprises a molded structure.

7. The ground power connector saver as claimed in claim 1, wherein:

the connector saver body comprises three cavities having inside dimensions and the socket group comprises three sockets with female tyne sections positioned within the cavities, respectively; and the female tyne sections of the sockets comprising outside dimensions, wherein the outside dimensions of the female tyne sections are smaller than the inside dimensions of their respective cavities so that the female tyne sections change positions within the cavities.

8. The ground power connector saver as claimed in claim 1, wherein:

the connector saver body comprises six cavities having inside dimensions and the socket group comprises six sockets with female tyne sections positioned within the cavities, respectively; and the female tyne sections of the sockets comprising outside dimensions, wherein the outside dimensions of the female tyne sections are smaller than the inside dimensions of their respective cavities so that the female tyne sections change positions within the cavities.

9. The ground power connector saver as claimed in claim 1, wherein the ground power connector is capable of being directly coupled to the aircraft fixed connector.

10. A ground power connector saver for electrically and mechanically connecting a ground power connector to an aircraft fixed connector, the connector saver comprising:

an internal block comprising a plurality of cavities, each cavity having an inside dimension and a pivot engagement;

a socket group comprising a plurality of sockets, each socket comprising a female tyne section comprising an outside dimension and a pivot engagement, wherein each female tyne section is positioned within a cavity, wherein the outside dimension of the female tyne sections are smaller than the inside dimensions of the cavities, wherein the pivot engagements of the internal block and the sockets are engaged to support the sockets in the cavities so as to enable the sockets to pivot within the cavities at the pivot engagements, wherein each socket of the socket group comprises a male pin contact, wherein the male pin contacts of the socket group have a configuration similar to the aircraft fixed connector; and a connector saver body that houses the internal block and the female tyne sections of the sockets and comprises a flexible portion that flexibly seals respective ends of the female tyne sections of the sockets in the cavities, wherein the male pin contacts of the socket group extend from the connector saver body.

11. The ground power connector saver as claimed in claim 10, wherein the plurality of sockets comprises three sockets, and the plurality of cavities comprises three cavities.

12. The ground power connector saver as claimed in claim 10, wherein the plurality of sockets comprises six sockets, and the plurality of cavities comprises six cavities.

13. A ground power connector saver for electrically and mechanically connecting a ground power connector to an aircraft fixed connector, the connector saver comprising:

a connector saver body; and a socket group positioned partially within the connector saver body, wherein each socket comprises a female tyne section and a male pin contact, wherein the male pin contacts of the socket group have a configuration similar to the aircraft fixed connector, wherein the female tyne section of a socket of the socket group is positioned within a cavity with a support in the connector saver body, wherein the female tyne section comprises an outside dimension, wherein the outside dimension of the female tyne section is smaller than an inside dimension of the cavity, wherein the support allows the female tyne section of the socket to change positions within the cavity.

* * * * *